US007042361B2

(12) United States Patent
Kazdin et al.

(10) Patent No.: US 7,042,361 B2
(45) Date of Patent: May 9, 2006

(54) CHILD MONITORING, COMMUNICATION AND LOCATING SYSTEM

(76) Inventors: Ronald S. Kazdin, 11900 Kinsman Rd., Newbury, OH (US) 44065; Thomas J. Radu, 17 Woodside Rd., Chagrin Falls, OH (US) 44022

( * ) Notice: Subject to any disclaimer, the term of this patent is extended or adjusted under 35 U.S.C. 154(b) by 0 days.

(21) Appl. No.: 10/676,452

(22) Filed: Oct. 2, 2003

(65) Prior Publication Data

US 2005/0073420 A1 Apr. 7, 2005

(51) Int. Cl.
*G08B 23/00* (2006.01)

(52) U.S. Cl. ..... 340/573.4; 340/539.1; 340/568.1; 340/572.1; 340/573.1; 340/539.15; 340/825.69

(58) Field of Classification Search ..... 340/573.4, 340/539.1, 505, 506, 539.13, 568.1, 572.1, 340/573.1, 573.3, 564, 539.15, 825.69
See application file for complete search history.

(56) References Cited

U.S. PATENT DOCUMENTS 4,136,338 A 1/1979 Antenore
5,067,441 A 11/1991 Weinstein
5,289,163 A 2/1994 Perez et al.
5,408,956 A 4/1995 Quigley
5,525,967 A * 6/1996 Azizi et al. ..... 340/572.1
5,661,460 A 8/1997 Sallen et al.
5,714,932 A * 2/1998 Castellon et al. ..... 340/539.11
5,812,056 A * 9/1998 Law ..... 340/539.15
6,650,241 B1 * 11/2003 Osborne et al. ..... 340/573.1
6,788,199 B1 * 9/2004 Crabtree et al. ..... 340/539.13

* cited by examiner

*Primary Examiner*—Jeffery Hofsass
*Assistant Examiner*—Daniel Previl
(74) *Attorney, Agent, or Firm*—D. Peter Hochberg; Sean Mellino; Katherine R. Vieyra

(57) ABSTRACT

A system for containing a child within a defined area, for communicating with the child, and for locating the child if the child leaves the defined area is disclosed. The containment capability of the system is provided by a presently existing electronic pet containment system. The child wears a monitoring module that produces a signal that is transmitted back to a control unit in the possession of the parent, thus warning the parent if the child approaches or crosses the wire defining the boundary of the defined area. The parent can use the control unit transceiver to communicate with the child and the child can communicate with the parent using the transceiver within the monitoring module. If the child leaves the defined area, the control unit has locating capabilities that provide the parent with an indication as to the direction in which the child is moving and the distance between the child and the control unit.

23 Claims, 4 Drawing Sheets

CHILD MONITORING, COMMUNICATION AND LOCATING SYSTEM

TECHNICAL FIELD

The present invention relates, in general, to a child containment, communication and locating system and, more particularly, to such a system wherein the child containment capability is provided by a presently existing pet containment system.

BACKGROUND ART

Numerous systems relating to containing, communicating with and locating children are presently available. Such systems, however, typically do not include all of the aforementioned capabilities. For example, U.S. Pat. No. 4,136,338 (Antenore) discloses a perimeter alarm apparatus including a loop of wire that is placed within the ground so as to define the area in which the child is to be contained and electrical circuitry connected to the loop to detect the absence of a signal imposed on the loop. A sending unit is worn by the child and produces a signal that is imposed on the loop. If the child is within the defined area, the sending unit induces a signal on the loop. When the child moves beyond the loop by a predetermined distance, no signal is imposed on the loop and an alarm is sounded. In the aforementioned patent, the signal is imposed on the loop by a sending unit worn by the child, rather than by a radio frequency transmitter under the control of the child's parent. In addition, means for communicating with the child or for determining the location of the child if the child leaves the defined area is not provided under the aforementioned patent.

U.S. Pat. No. 5,661,460 (Sallen et al.) discloses a distance determination and alarm system comprised of a plurality of transceiver units, one transceiver unit being in the possession of the parent and the other transceiver unit being worn by the child. The system produces an alarm when the transceiver unit worn by the child is more than a predetermined distance away from the transceiver unit in the possession of the parent. The distance is determined by the difference in the phase of a reference signal that is transmitted on a radio frequency signal by the parent's transceiver unit, then received and retransmitted by the child's transceiver unit, and then received again by the parent's transceiver unit. This patent does not include any means for containing the child within a predetermined area and/or means for communicating with the child or locating the child.

U.S. Pat. No. 5,289,163 (Perez et al.) discloses a child locating device consisting of two transceiver units. The child's transceiver unit generates a signal that is received by the parent's transceiver unit. If the signal generated by the child's transceiver unit becomes weak as the result of the child exceeding a predetermined distance from the parent's transceiver unit, an alarm is sounded by the parent's transceiver unit to alert the parent that the child has wandered away. The parent's transceiver unit also has a direction indicator function to assist in locating the child. This patent, however, makes no provision for containing the child within a predetermined area.

U.S. Pat. No. 5,812,056 (Law) discloses a wireless child monitoring and locating device consisting of a transmitter worn by the child and a receiver in the possession of the parent. The parent's receiving unit is capable of detecting when the child strays beyond a predetermined distance from the parent. This patent makes no reference to means for containing the child with a predetermined area and/or means for communicating with the child or for locating the child if the child leaves a predetermined area.

In view of the foregoing, it has become desirable to develop a system for containing a child within a defined area, communicating with that child when the child is within the defined area or outside the defined area, and for locating the child when the child has strayed from the defined area, using a wire loop located in the ground.

SUMMARY OF THE INVENTION

The present invention solves the problems associated with the prior art systems for monitoring a child within a defined area, communicating with and/or locating a child, and other problems by providing a system that includes means for monitoring a child within a defined area, for communicating with the child and for locating the child if the child leaves the defined area. Utilizing a presently existing electronic pet containment system provides the containment capability of the system. Such a containment system utilizes a wire that is placed within the ground and on which a signal is applied thereto. The child wears a child monitoring module through which communication with a control unit can be maintained via radio frequency links. The control unit, which is typically in the possession of the child's parent, emits an audible alarm thus warning the parent that the child is approaching the wire. A similar audible alarm is also provided to the child by the monitoring unit. The parent can then use the transceiver associated with the control unit to communicate with the child and the child can communicate with the parent by using the transceiver in the child monitoring module. If the child crosses the wire defining the boundary of area, the audible alarm associated with the control unit changes pitch indicating to the parent that the child has crossed the established boundary. If the child crosses the established boundary and if the radio frequency capability of the control unit has been exceeded, the system includes an auxiliary power unit to increase the level of the radio frequency signal to and from the child monitoring module. The system also includes directional and distance locating capabilities to provide an indication to the parent as to the direction in which the child is moving and the distance between the child and the control unit.

DESCRIPTION OF THE PREFERRED EMBODIMENT

Figure 1:
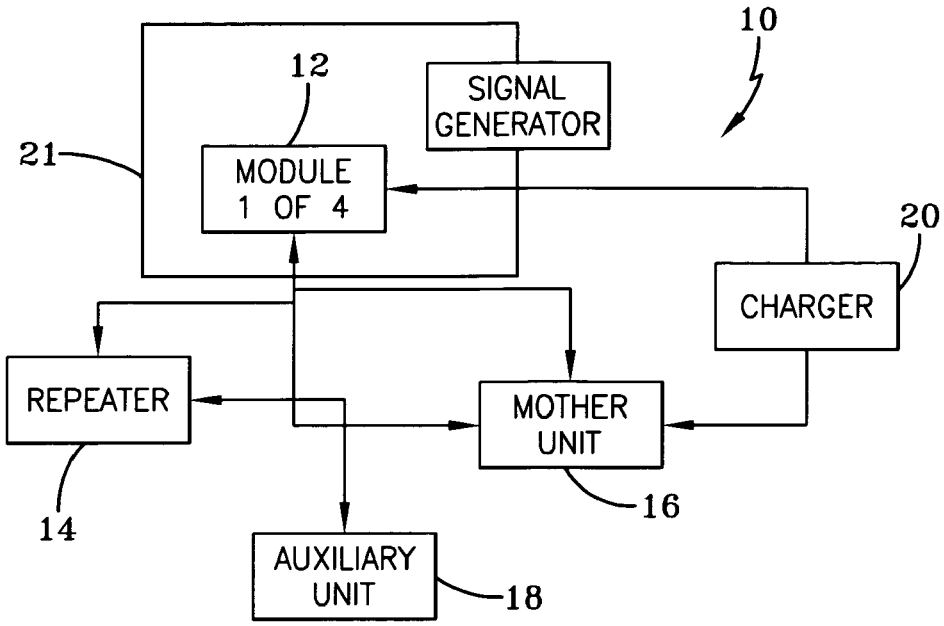
FIG. 1 is a schematic diagram of the child monitoring, communication and locating system of the present invention.
Figure 7:
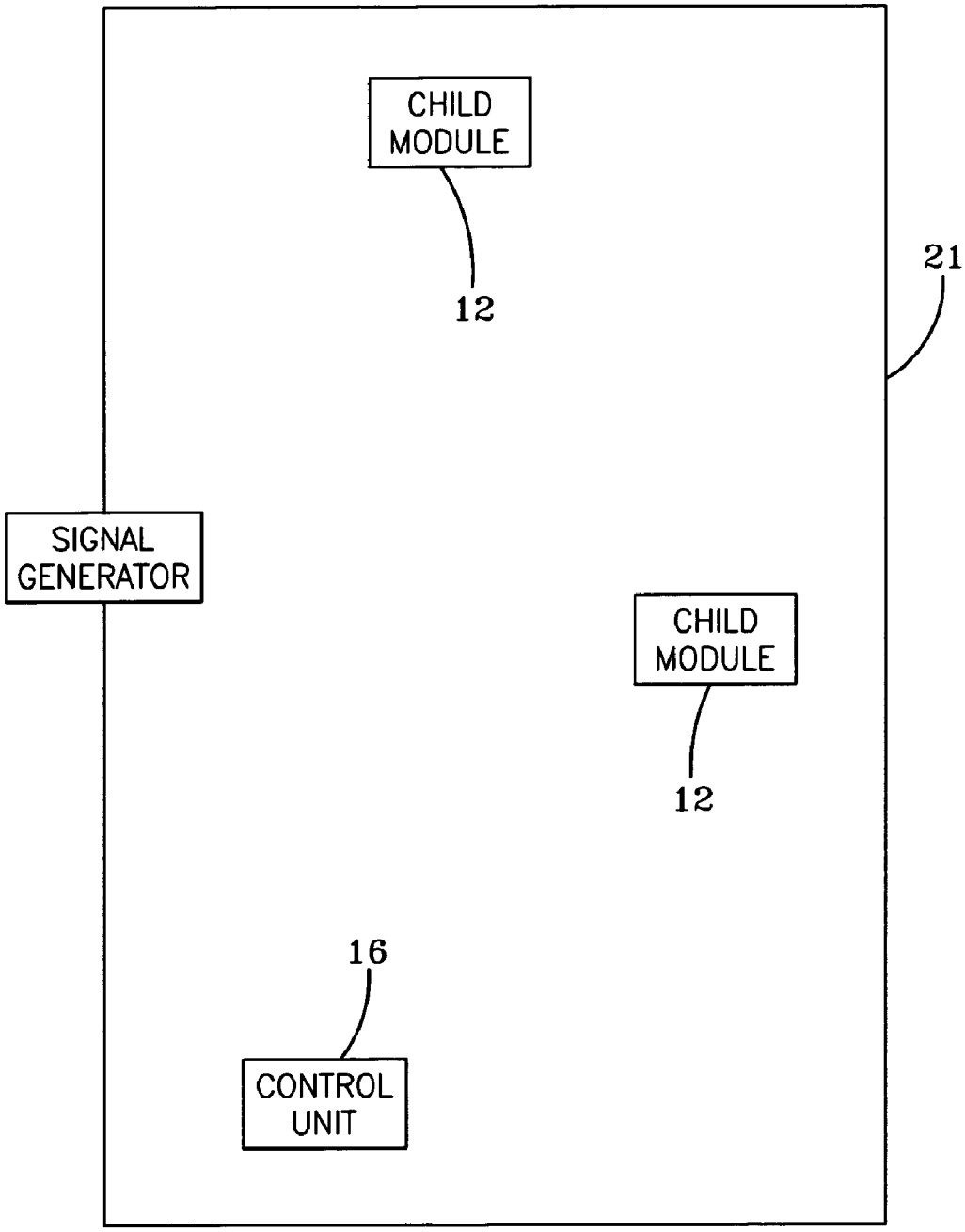
FIG. 7 is a schematic diagram of the child monitoring, communication and locating system in a pet containment area defined by a wire charged by a signal generator.

Referring not to the drawings where the illustrations are for the purpose of describing the preferred embodiment of the present invention and are not intended to limit the invention described herein, FIG. 1 is a schematic diagram of the child monitoring, communication and locating system 10 of the present invention. The system 10 is comprised of one or more child monitoring modules 12, a repeater 14, a control unit 16, an auxiliary power unit 18 and a battery charger 20. The child monitoring module 12 is worn by the child whose movements are being monitored within an area determined by a wire 21 defining the periphery of a dog containment area. Wire 21 is charged by a signal generator. Control 16 could be located within or outside of the area defined by wire 21. This is shown schematically in FIG. 7. The module 12 transmits signals or selected data on a radio frequency band to the repeater 14, the control unit 16 and to the auxiliary power unit 18. The radio frequency band has a predetermined frequency with a particular data, such as the child's telephone number, referred to below as system input data. The repeater 14 receives and retransmits signals or selected data from the child monitoring modules 12 to extend the range of the modules 12 and to fill gaps in the radio frequency reception area. The control unit 16 receives data from either the modules 12 or the repeater 14 and controls the operation of the system 10. The auxiliary power unit 18 receives signals or selected data from the repeater 14 and extends the detection range of the modules 12. The battery charger 20 provides controlled recharging of the batteries within the modules 12 and within the control unit 16.

Figure 2:
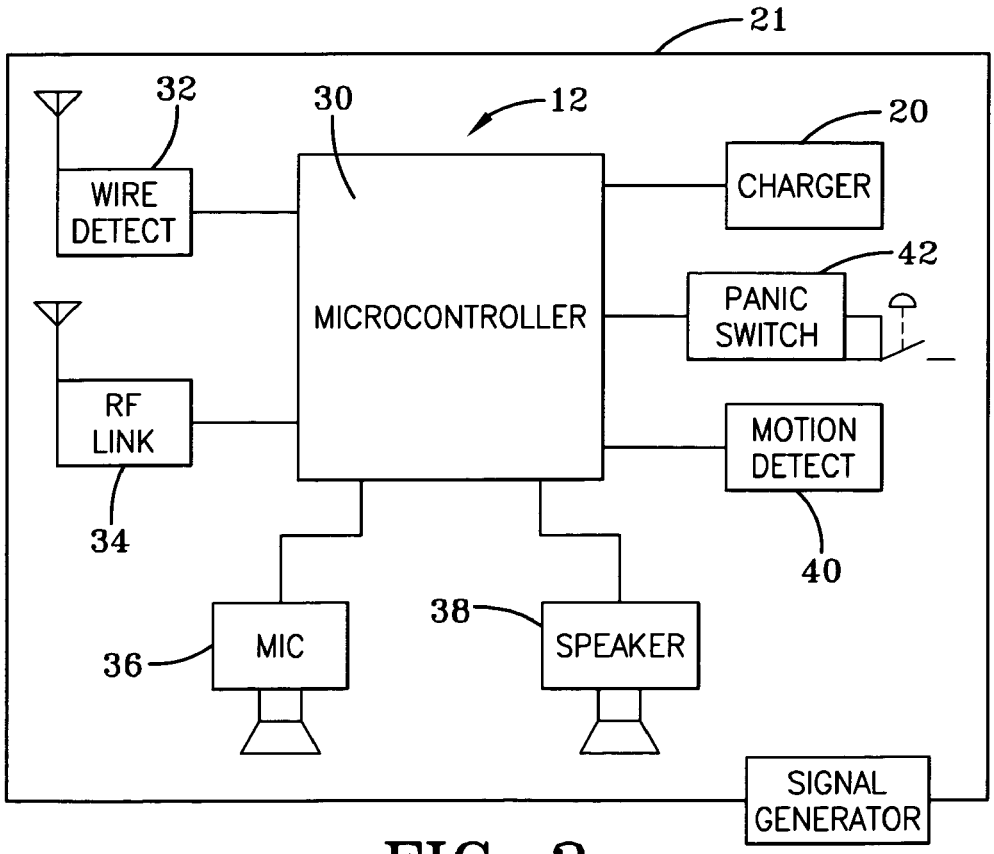
FIG. 2 is a schematic diagram of a child monitoring module utilized by the child monitoring, communication and locating system of the present invention.

Referring now to FIG. 2, a schematic diagram of a child monitoring module 12 is shown. The module 12 includes a microcontroller 30, a wire detector 32, a radio frequency link 34, a microphone audio input 36, a speaker audio output 38, a motion detector 40 and a panic switch 42. Microcontroller 30, like the other microcontrollers discussed herein, is programmable with system input data. The wire detector 32 is connected to an input to the microcontroller 30 and detects existing signals from the wire defining the periphery of the dog containment area. The radio frequency link 34 is comprised of a transceiver that permits the module 12 to communicate with the control unit 16 using a radio frequency band or system input data. Wire detector 32 thus generates a wire frequency signal when a wire is detected, wire detector 32 having received a signal above a predetermined magnitude. The microphone 36 provides an audio input to the microcontroller 30. The speaker 38 provides an audio output from the microcontroller 30. The motion detector 40 detects movement by the child and is connected to an input to the microcontroller 30. Motion detector 40 generates a motion-stationary electronic signal when said module 12 is stationary for some predetermined period of time. The panic switch 42 can be actuated by the child and is connected to an input to the microcontroller 30 and notifies the person monitoring the child, such as the child's mother, to communicate with the module 12 worn by the child. The battery charger 20 is connectable to an input to the microcontroller 30 to recharge the batteries within the module 12.

Figure 3:
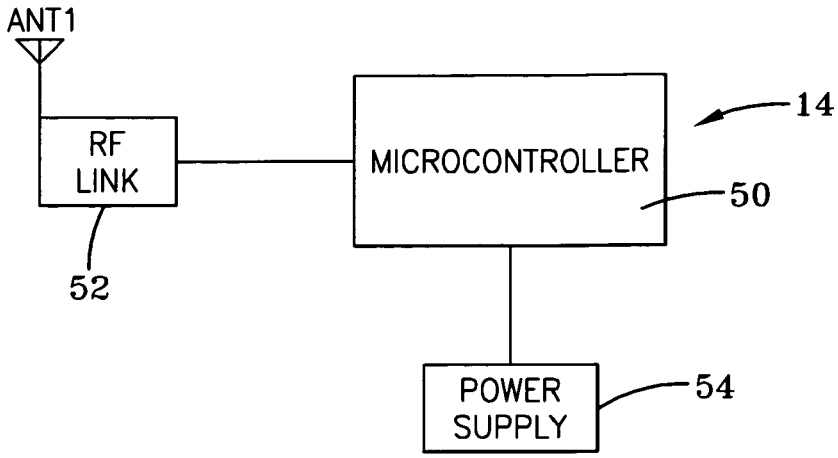
FIG. 3 is a schematic diagram of the repeater utilized by the child monitoring, communication and locating system of the present invention.

A schematic diagram of the repeater 14 is shown in FIG. 3. The repeater 14 is comprised of a microcontroller 50, a radio frequency link 52 and a power supply 54. The repeater 14 receives and retransmits signals or selected data from the modules 12, extending the range of the modules 12 and filling the gaps in the radio frequency reception area. The radio frequency link 52 comprises a transceiver that communicates with the child monitoring module 12 using the radio frequency band. The power supply 54 receives power from a 110 volt AC source and includes an adapter that converts the AC power to DC power to recharge the batteries within the repeater 14.

Figure 4:
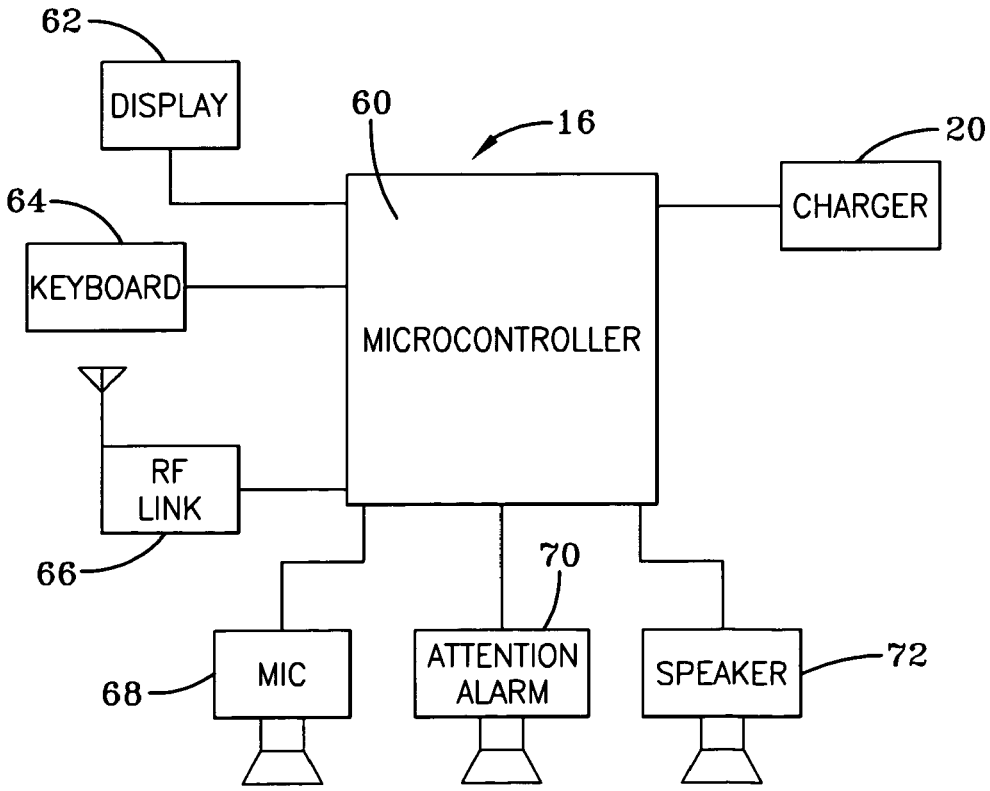
FIG. 4 is a schematic diagram of the control unit utilized by the child monitoring, communication and locating system of the present invention.

Referring now to FIG. 4, a schematic diagram of the control unit 16 is shown. The control unit 16 includes a microcontroller 60, a display 62, a keyboard 64, a radio frequency link 66, a microphone audio input 68, an attention alarm 70 and a speaker audio output 72. The display 62 is comprised of a two line, 16 character liquid crystal display and is used to display the operating functions of the system 10. The keyboard 64 is utilized to input data into the system 10 and to control the operation of same. The radio frequency link 66 is comprised of a transceiver that communicates with the child monitoring module 12 using the radio frequency band, i.e. the system input data. The microphone 68 is connected to an input to the microcontroller 60. The attention alarm 70 and the speaker 72 are connected to outputs of the microcontroller 60. The battery charger 20 is connected to an input to the microcontroller 60 and is utilized to recharge the batteries within same.

Figure 5:
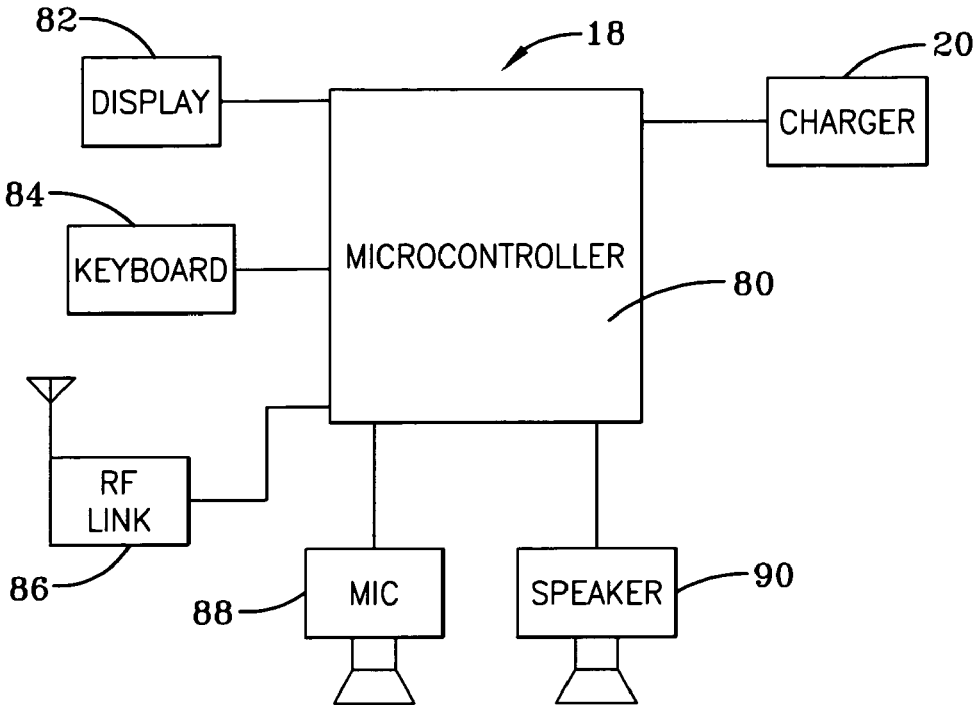
FIG. 5 is a schematic diagram of the auxiliary power unit utilized by the child monitoring, communication and locating system of the present invention.

A schematic diagram of the auxiliary power unit 18 is shown in FIG. 5. The auxiliary power unit 18 is comprised of a microcontroller 80, a display 82, a keyboard 84, a radio frequency link 86, a microphone audio input 88 and a speaker audio output 90. The display 82 is comprised of a screen and is used to display the operating functions of the system 10 and the location of the child wearing the child monitoring module 12. The keyboard 84 is used to input data into the system 10 and to control the operation of same. The radio frequency link 86 is comprised of a transceiver which communicates with the child monitoring module 12 using the radio frequency band and which extends the range of the system 10 for several miles. The microphone 88 is connected to an input to the microcontroller 80. The speaker 90 is connected to an output of the microcontroller 80. The battery charger 20 is connectable to an input to the microcontroller 80 and is used to recharge the batteries within the same.

Figure 6:
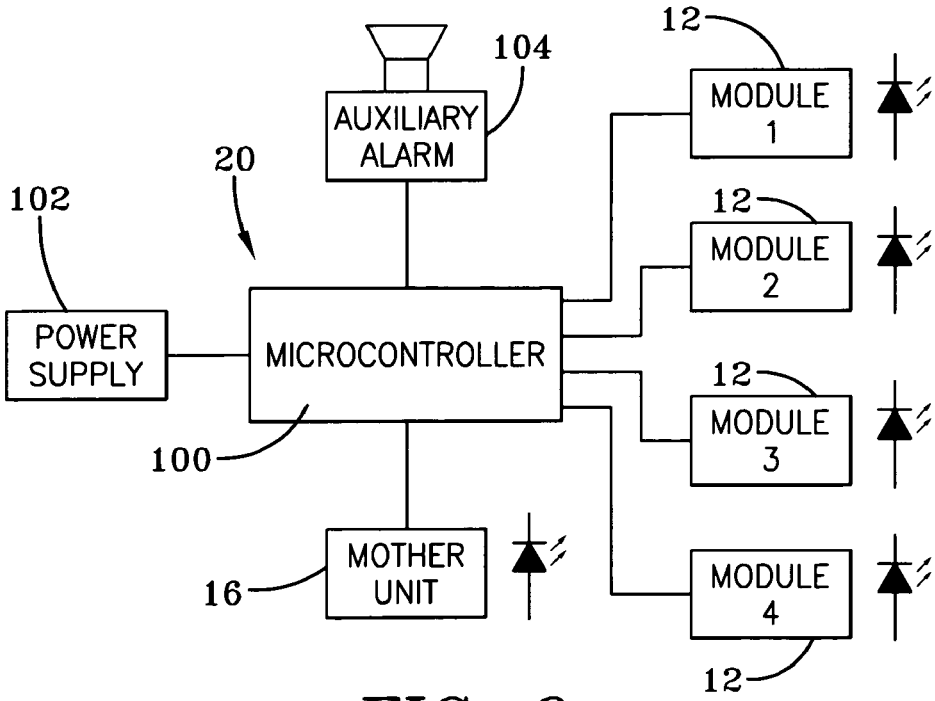
FIG. 6 is a schematic diagram of the battery charger utilized by the child monitoring, communication and locating system of the present invention.

Referring now to FIG. 6, a schematic diagram of the battery charger 20 is illustrated. The battery charger 20 is comprised of a microcontroller 100, a power supply 102 and an auxiliary alarm 104. The power supply 102 provides power to the microcontroller 100. The auxiliary alarm 104 provides an additional alarm for the system 10. Charging jacks are provided on the charger 20 permitting the recharging of up to four (4) child monitoring modules 12 and the control unit 16. Light emitting diodes (not shown) are provided on the charger 20 to indicate the charging status of each module 12 that is connected to the charger 20.

The control unit 16 is typically located within a residence that has a pet containment system associated therewith. The pet containment system includes a generator that produces the signals that are applied to the wire that defines the periphery of the pet containment area. As previously indicated, the child monitoring module 12 is worn by the child whose movements are being monitored within the area determined by the wire defining the periphery of the pet containment area.

To operate the system 10 of the present invention, the control unit 16 and one or more child monitoring modules 12 are initially charged by the charger 20. After charging has been completed, using the keyboard 64 associated with the control unit 16, the control unit 16 is programmed to insure the accessibility of each of the child monitoring modules 12. The system input data that is programmed into the control unit 16 may include the name, address, telephone number, and a unique radio frequency or channel (RF link) of the child who will wear the child monitoring module 12 and a unique digital identifier code for the module 12. Assuming that two (2) child monitoring modules 12 are involved for discussion purposes, the control unit 16 would be programmed for each of the two modules 12 and programs same. After programming has been completed, the first child monitoring module 12 is attached to the first child and the second child monitoring module 12 is attached to the second child whose movements are being monitored within an area determined by the wire defining the periphery of a dog containment area. Modules 12 emit RF monitoring signals. If the mother of the children wearing the modules 12 would like to talk to the first child, the mother presses the voice command button associated with the control unit 16 and speaks to the first child via the microphone 68 in the control unit 16. The transceiver comprising the radio frequency link 66 in the control unit 16 transmits the mother's message to the first child via the radio frequency link 343 and the speaker 38 in the first child's module 12. When the mother has completed her message to the first child, the first child can respond to the mother via the microphone 36 in its module 12. The transceiver comprising the radio frequency link 34 in the module 12 transmits the first child's message to the mother via the radio frequency link 66 and the speaker 72 associated with the control unit 16. If the mother would like to listen to either of the children, the mother accesses the child monitoring module 12 worn by that child and presses the voice command button on the control unit 16. As long as the voice command button is depressed, the child's voice will be transmitted via the microphone 36 in its module 12. Here again, the transceiver comprising the radio frequency link 34 in the child's module 12 transmits the child's voice to the mother via the radio frequency link 66 and the speaker 72 associated with the control unit 16.

If one of the children decides to remove its child monitoring module 12, the motion detector 40 associated with the module 12 detects that no motion is occurring to the module 12 and causes the transceiver comprising the radio frequency link 34 in the module 12 to transmit a signal via radio frequency link 66 to control unit 16 activating the attention alarm 70 in the control unit 16. The mother in this instance can investigate why the child has removed its module 12 and take appropriate corrective action. After taking such action, the mother then resets attention alarm 70 associated with control unit 16. If one of the children seeks the mother's attention, the child pushes the panic switch 42 associated with its module 12 causing the transceiver comprising the radio frequency link 34 in the module 12 to transmit a signal via radio frequency link 66 to the control unit 16 causing the attention alarm 70 in the control unit 16 to again be activated. In this case, the mother would take the appropriate action and then reset the attention alarm 70 associated with control unit 16.

If the child decides to leave the area typically defined by the wire associated with the pet containment system, the wire detector 32 associated with its module 12 detects that the child is approaching the wire and causes the transceiver comprising the radio frequency link 34 in the module 12 to transmit a signal via radio frequency link 66 to control unit 16 activating attention alarm 70 in the control unit 16. In this instance, the mother can then investigate the location of the child and take appropriate action. After the mother has taken appropriate action, the mother then resets the attention alarm 70 associated with the control unit 16. If the child crosses the wire defining the confined area before the mother takes appropriate action, the attention alarm 70 associated with the control unit 16 changes pitch indicating to the mother that the child has crossed the established boundary. The mother, in this instance, can then press the voice command button associated with the control unit 16 and speak to the child via the microphone 68 in the control unit 16. The transceiver comprising the radio frequency link 66 in the control unit 16 transmits the mother's message to the child via radio frequency link 34 and the speaker 38 in the module 12 worn by the child. If the child ignores the voice messages of the mother, the mother can activate the directional and distance location capabilities or system of the control unit 16. Using the directional and location capabilities of the control unit 16, the mother can then locate the child. In a direction and distance location system, control unit 16 is moved such as through an arc to determine the strongest monitoring signals from module 12. The strongest signals indicate the direction of module 12, and the strength of the signals indicates the distance to module 12.

If the child has crossed the wire defining the confined area and if the radio frequency capability of the control unit 16 has been exceeded, i.e., communication has been lost between the control unit 16 and the child monitoring module 12, the transceiver comprising the radio frequency link 66 in the control unit 16 causes the activation of auxiliary power unit 18 via radio frequency link 86 associated with auxiliary power unit 18. The auxiliary power unit 18 increases the level of the radio frequency signal to and from the child monitoring module 12. The mother can then call the police for assistance. Through directional and distance locating methods, the police will then attempt to locate the child using the signal transmitted by the auxiliary power unit 18 and received from the child monitoring unit 12. Of course, the directional and distance location system of control unit 16 can be used by moving unit 16 (or the antenna thereon) to track the child as discussed above.

If the police cannot locate the child through directional and distance locating methods, System Omni can be activated to scan a larger geographical area. System Omni can determine the location of an individual by coordinates, and such information is then transmitted to the police who can determine the individual's location. If the police cannot locate the child, all System Omni units in the surrounding areas can be utilized to locate the child. In this instance, any control unit 16 within the radio frequency range of the child monitoring module 12 can intercept the signal from the module 12, along with the child's telephone number and the unique digital identifier code that has been assigned to the child, permitting communication to the police of the child's approximate location. In this manner, the child can be located.

It should be noted that if the battery power level within the child monitoring module 12 drops to a predetermined level, the control unit 16 is notified of same by the transceiver comprising the radio frequency link 34 in the module 12 and the radio frequency link 66 in the control unit 16. In this situation, voice communication between the module 12 and the control unit 16 ceases. If the power level of the module 12 drops further, the transceiver comprising the radio frequency link 34 in the module 12 produces a signal which is transmitted via the radio frequency link 34 to the control unit 16 via radio frequency link 66 causing the control unit 16 to sound an alarm. In this instance, the control unit 16 cannot be reset until the child monitoring module 12 has been recharged.

Certain modifications and improvements will occur to those skilled in the art upon reading the foregoing. It is understood that all such modifications and improvements have not been included herein for the sake of conciseness and readability, but are properly within the scope of the following claims.

We claim:

1. A child monitoring, communication and locating system for use with an electronic apparatus, the electronic apparatus having a wire defining a periphery of a containment area and a generator to apply an electronic signal to the wire, the wire emitting a first radio frequency signal, said system comprising:

a control unit comprising:

a control unit microcontroller, said control unit microcontroller being programmable with at least one system input data; and a control unit transceiver;

at least one child module to be carried by a child, said child module comprising:

a child module microcontroller;

a wire detector for detecting a first radio frequency signal from the wire and for generating wire detection signals in response to the detection of a wire when said wire detector is a predetermined distance from the wire; and a child module transceiver for electronically connecting said wire detector to said control unit transceiver, said child module microcontroller being programmable with a system input data code corresponding to the system input data programmed into said control unit for establishing a unique radio frequency channel between said child module transceiver and said control unit;

said child module transceiver transmitting an alarm signal on said unique frequency channel to said control unit transceiver in response to said wire detector being a predetermined distance from the wire defining the perimeter of a containment area, said control unit transceiver generating a responsive alarm in response to receiving said alarm signal.

2. A system according to claim 1 wherein said wire detector generates wire detection signals in response to detecting a first radio frequency signal in the wire exceeding a first predetermined minimum magnitude.

3. A system according to claim 2 wherein said first responsive alarm is an audible alarm having a first switch, and said second responsive alarm is an audible alarm having a second pitch different from the first pitch.

4. A system according to claim 1 wherein said control unit has a display panel, and said responsive alarm is visible on said display panel.

5. A system according to claim 1 wherein said child module transceiver generates an alarm for recognition by the child carrying said child module when said child module transceiver transmits an alarm signal.

6. A system according to claim 1 wherein said child module transceiver generates monitoring signals, and said control unit comprises a directional and distance locating system for finding the strongest of said monitoring signals to determine the direction and distance to said child for locating said child module.

7. A system according to claim 1 wherein said at least one child module further comprises a motion detector for generating a motion-stationary electronic signal in response to a lack of motion of said at least one child module for a predetermined period of time, and said child module transceiver transmitting said motion-stationary electronic signal from said child module to said control unit transceiver, said control unit transceiver emitting an alarm in response to receiving said motion-stationary electronic signal.

8. A system according to claim 1 and further including an audio system, said audio system comprising:

a child module audio input in said child module transceiver for transmitting audio signals from said child module;

a control unit audio input in said control unit transceiver for transmitting audio signals from said control unit;

a control unit audio output at said control unit for receiving said audio signals from said child module; and a child module audio output at each child module for receiving said audio signals from said control unit.

9. A system according to claim 8 wherein each of said audio inputs comprises a microphone, and said audio signals are voice signals.

10. A system according to claim 1 wherein:

said child module transceiver comprises an audio input having a microphone for transmitting voice message signals from said child module and an audio output having a speaker for emitting voice messages in response to voice message signals from said control unit transceiver; and said control unit transceiver comprises an audio input having a microphone for transmitting voice message signals from said control unit and an audio output having a speaker for emitting voice messages in response to voice message signals from said child module transceiver.

11. A system according to claim 10 wherein said at least one child module is at least two child modules, and wherein said system further comprises an activation device having an on mode for activating said microphone audio input of said control unit transceiver and said speaker of said child module transceivers for enabling the transmission of voice signals from said control unit to a plurality of said child modules, said activation device having an off mode for deactivating said microphone audio input of said control unit transceiver.

12. A system according to claim 1 and further including a repeater, said repeater comprising:

a repeater microcontroller;

a power supply for said repeater microcontroller; and a repeater radio frequency link operatively connected to said child module transceiver for extending the range of said child module transceiver on said unique frequency channel.

13. A system according to claim 1 wherein said control unit comprises:

a power supply for said control unit microprocessor; and a control unit radio frequency link operatively connected to said control unit microcontroller and comprising said control unit transceiver;

said control unit microcontroller effecting the generation of a responsive alarm signal by said control unit transceiver in response to the reception by said control unit transceiver of an alarm signal from said child module alarm.

14. A system according to claim 1 and further including an auxiliary power unit for extending the detection range of said at least one child module, said auxiliary power unit comprising:

an auxiliary power unit microcontroller;

a power supply for said auxiliary power link; and an auxiliary power unit frequency link operatively connected to said auxiliary power microcontroller and comprising an auxiliary power unit transceiver;

said auxiliary power unit transceiver receiving alarm signals from said at least one child module on said unique frequency and extending the transmission of said alarm signals on said unique frequency.

15. A child monitoring, communication and locating system for use with an electronic apparatus, the electronic apparatus having a wire defining a periphery of a containment area and a generator to apply an electronic signal to the wire, the wire emitting a first radio frequency signal, said system comprising:

a control unit comprising:

a control unit microcontroller, said control unit microcontroller being programmable with at least one system input data; and a control unit transceiver;

at least one child module to be carried by a child, said child module comprising:

a child module microcontroller;

a wire detector for detecting a first radio frequency signal from the wire and for generating a first wire detection signal in response to detecting a first predetermined distance from the wire and for generating a second wire detection signal in response to detecting a second predetermined distance from the wire;

a child module transceiver for electronically connecting said wire detector to said control unit transceiver, said child module microcontroller being programmable with a system input data corresponding to the system input data programmed into said control unit for establishing a unique radio frequency channel between said child module transceiver and said control unit transceiver;

said child module transmitting a first alarm signal on said unique frequency channel to said control unit transceiver in response to the first wire detection signal, said control unit transceiver generating a first responsive alarm in response to receiving said first alarm signal, and said child module transmitting a second alarm signal on said unique frequency channel to said control unit transceiver in response to the second wire detection signal, said control unit transceiver generating a second responsive alarm in response to receiving said second alarm signal.

16. A system according to claim 15 wherein said first responsive alarm is an audible alarm having a first pitch, and said second responsive alarm is an audible alarm having a second pitch different from the first pitch.

17. A child monitoring, communication and locating system for use with an electronic apparatus, the electronic apparatus having a wire defining a periphery of a containment area and a generator to apply an electronic signal to the wire, the wire emitting a first radio frequency signal, said system comprising:

a control unit comprising:

a control unit microcontroller, said control unit microcontroller being programmable with at least one system input data; and a control unit transceiver;

at least one child module to be carried by a child, said child module comprising:

a child module microcontroller;

a wire detector for detecting a first radio frequency signal from the wire and for generating a first wire detection signal in response to detecting a first predetermined distance from the wire and for generating a second wire detection signal in response to detecting said child module crossing the wire;

a child module transceiver for electronically connecting said wire detector to said control unit transceiver, said child module microcontroller being programmable with a system input data corresponding to the system input data programmed into said control unit for establishing a unique radio frequency channel between said child module transceiver and said control unit transceiver;

said child module transmitting a first alarm signal on said unique frequency channel to said control unit transceiver in response to the first wire detection signal, said control unit transceiver generating a first responsive alarm in response to receiving said first alarm signal, and said child module transmitting a second alarm signal on said unique frequency to said control unit transceiver in response to the second wire detection signal, said control unit transceiver generating a second responsive alarm in response to receiving said second alarm signal.

18. A child monitoring, communication and locating system, said system comprising:

a control unit comprising:

a control unit microcontroller, said control unit microcontroller being programmable with at least one system input data; and a control unit transceiver;

at least one child module to be carried by a child, said child module comprising:

a child module microcontroller;

a child module transceiver being electronically connectible with said control unit transceiver for exchanging electronic signals with said control unit transceiver;

said child monitoring, communication and locating system further comprising:

a motion detector system for generating a motion-stationary electronic signal in response to lack of motion of said child module for a predetermined period of time, and said child module transceiver transmitting said motion-stationary electronic signal from said child module to said control unit transceiver, said control unit transceiver emitting an alarm in response to receiving said motion stationary electronic signal;

an audio communication system, said audio communication system comprising:

a child module audio input in said child module transceiver for transmitting audio signals from said child module;

a control unit audio input in said control unit transceiver for transmitting audio signals from said control unit;

a control unit audio output at said control unit for receiving said audio signals from said child module audio input and for emitting output signals; and a child module audio output at said child module for receiving said audio signals from said control unit audio input and for emitting output signals;

a directional and distance locating system comprising:

a monitoring signal output in said child module transceiver for transmitting monitoring signals; and a movable directional and distance locating signal input in said control unit for moving to receive the maximum strength of said monitoring signals to determine the direction of the child module and distance of the child module according to the strength of the monitoring signals; and a monitoring system for determining if a child module is within a predetermined distance from said control unit, said monitoring system comprising:

said monitoring signal output in said child module transceiver for transmitting monitoring signals; and said control unit transceiver for receiving the monitoring signals and generating an alarm if said monitoring signals fall below a predetermined value.

19. A child monitoring, communication and locating system, said system comprising:

a control unit comprising:

a control unit microcontroller, said control unit microcontroller being programmable with at least one system input data; and a control unit transceiver;

at least one child module to be carried by a child, said child module comprising:

a child module microcontroller;

a child module transceiver being electronically connectible with said control unit transceiver for exchanging electronic signals with said control unit transceiver;

said child monitoring, communication and locating system further comprising:

a motion detector system for generating a motion-stationary electronic signal in response to lack of motion of said child module for a predetermined period of time, and said child module transceiver transmitting said motion-stationary electronic signal from said child module to said control unit transceiver, said control unit transceiver emitting an alarm in response to receiving said motion stationary electronic signal;

an audio communication system, said audio communication system comprising:

a child module audio input in said child module transceiver for transmitting audio signals from said child module;

a control unit audio input in said control unit transceiver for transmitting audio signals from said control unit;

a control unit audio output at said control unit for receiving said audio signals from said child module; and a child module audio output at said child module for receiving said audio signals from said control unit;

a directional and distance locating system comprising:

a monitoring signal output in said child module transceiver for transmitting monitoring signals; and a movable directional and distance locating signal input in said control unit for moving to receive the maximum strength of said monitoring signals to determine the direction and distance of the child module according to the strength of the monitoring signals; and a wire detection system for detecting a wire defining the perimeter of a containment area, the wire having an electronic signal generated and applied to the wire and emitting a wire radio frequency signal, said wire detection system comprising:

a wire detector for detecting the wire radio frequency signal and for generating wire detector signals in response to the detection of a wire;

said child module transceiver being electronically connected to said wire detector for transmitting signals corresponding to said wire detection signals to said control unit transceiver, said control unit transceiver generating an alarm signal when said signals corresponding to said wire detection signals exceeds a predetermined minimum.

20. A child monitoring, communication and locating system, said system comprising:

a control unit comprising:

a control unit microcontroller being programmable with at least one system input data; and a control unit transceiver;

at least one child module to be carried by a child, said child module comprising:

a child module microcontroller being programmable with a system input data corresponding to the at least one system input data programmed into said control unit microcontroller for establishing a unique radio frequency channel between said child module transceiver and said control unit;

a child module transceiver being electronically connectible with said control unit transceiver for exchanging electronic signals with said control unit transceiver;

said child monitoring, communication and locating system further comprising:

a motion detector system for generating a motion-stationary electronic signal in response to lack of motion of said child module for a predetermined period of time, and said child module transceiver transmitting said motion-stationary electronic signal from said child module to said control unit transceiver, said control unit transceiver emitting an alarm in response to receiving said motion-stationary electronic signal;

an audio communication system, said audio communication system comprising:

a child module audio input in said child module transceiver for transmitting audio signals from said child module;

a control unit audio input in said control unit transceiver for transmitting audio signals from said control unit;

a control unit audio output at said control unit for receiving said audio signals from said child module; and a child module audio output at said child module for receiving said audio signals from said control unit;

a directional and distance locating system comprising:

a monitoring signal output in said child module transceiver for transmitting monitoring signals; and a movable directional and distance locating signal input in said control unit for moving to receive the maximum strength of said monitoring signals to determine the direction and distance of the child module according to the strength of the monitoring signals; and a wire detection system for use with an electronic apparatus, the electronic apparatus having a wire defining a periphery of a containment area and a generator to apply an electronic signal to the wire, the wire emitting a first radio frequency signal, said wire detection system comprising:

a wire detector for detecting a first radio frequency signal from the wire when said wire is a predetermined distance from the wire and for generating wire detection signals in response to the detection of a wire;

said child module transceiver electronically connecting said wire detector to said control unit transceiver, and said child module transmitting an alarm signal on said unique frequency channel to said control unit transceiver in response to said wire detector being a predetermined distance from the wire defining the periphery of the containment area, said control unit transceiver generating a responsive alarm in response to receiving said alarm signal.

21. A system according to claim 20 wherein said wire detector generates wire detection signals in response to detecting a first radio frequency signal in the wire exceeding a first predetermined minimum magnitude.

22. A system according to claim 20 wherein said child module further includes a panic switch electronically connected to said child module microcontroller for actuation by the child carrying said child module for generating a signal at said control unit for requesting a guardian at the control unit to transmit an audio signal from said control unit audio input to said child module audio output.

23. A system according to claim 20 wherein said control unit comprises a resetting structure for resetting said control unit after the emission of an alarm by said control unit.

* * * * *